US010388301B2

(12) United States Patent
Kim et al.

(10) Patent No.: US 10,388,301 B2
(45) Date of Patent: Aug. 20, 2019

(54) METHOD FOR PROCESSING AUDIO SIGNAL AND ELECTRONIC DEVICE FOR SUPPORTING THE SAME

(71) Applicant: Samsung Electronics Co., Ltd., Suwon-si, Gyeonggi-do (KR)

(72) Inventors: Choon-Ho Kim, Suwon-si (KR); Kyuhan Kang, Suwon-si (KR); Gangyoul Kim, Seongnam-si (KR); Kiwon Kim, Seongnam-si (KR); Minseok Kim, Yongin-si (KR); Jin-Woo Park, Seongnam-si (KR); Gunhyuk Yoon, Suwon-si (KR); Sangphil Hong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/033,841

(22) Filed: Jul. 12, 2018

(65) Prior Publication Data

US 2019/0122687 A1 Apr. 25, 2019

(30) Foreign Application Priority Data

Oct. 24, 2017 (KR) ..... 10-2017-0138187

(51) Int. Cl.
*G10L 21/0232* (2013.01)
*H04R 1/40* (2006.01)
(Continued)

(52) U.S. Cl.
CPC ..... *G10L 21/0232* (2013.01); *H04R 1/403* (2013.01); *H04R 3/04* (2013.01); *H04R 3/12* (2013.01); *G10L 2021/02082* (2013.01)

(58) Field of Classification Search
CPC ..... G10L 21/0232; G10L 2021/02082; H04R 1/403; H04R 3/04; H04R 3/12
See application file for complete search history.

(56) References Cited

U.S. PATENT DOCUMENTS

2004/0252827 A1 12/2004 Sasaki
2006/0098810 A1 5/2006 Kim
(Continued)

OTHER PUBLICATIONS

International Search Report dated Oct. 19, 2018, issued in International Application No. PCT/KR2018/007882.

*Primary Examiner* — Andrew L Sniezek
(74) *Attorney, Agent, or Firm* — Jefferson IP Law, LLP

(57) ABSTRACT

An electronic device for processing an audio signal is provided. The electronic device includes a communication circuit, a microphone, a connector and a processor. The processor identifies whether the external cable connected with a first external electronic device and including a resistor having a resistance value equal to or greater than a designated resistance value is connected to the connector, and in response to identifying that the external cable is connected to the connector, transmit a first audio signal to the first external electronic device through the external cable, and receive a second audio signal including an echo signal and a voice signal through the microphone, and cancel the echo signal corresponding to the first audio signal, based at least partly on a delay time corresponding to the external cable and a parameter related with a filter corresponding to the external cable.

20 Claims, 10 Drawing Sheets

(51) Int. Cl.

| | |
|---|---|
| ***H04R 3/04*** | (2006.01) |
| ***H04R 3/12*** | (2006.01) |
| *G10L 21/0208* | (2013.01) |

(56) References Cited

U.S. PATENT DOCUMENTS

| | | | | |
|---|---|---|---|---|
| 2007/0098190 | A1 | 5/2007 | Song et al. | |
| 2007/0121804 | A1 | 5/2007 | Peng | |
| 2014/0003616 | A1 | 1/2014 | Johnson et al. | |
| 2015/0334520 | A1 | 11/2015 | Park et al. | |
| 2016/0029136 | A1* | 1/2016 | Kelloniemi | H04R 27/00 381/77 |
| 2016/0127527 | A1* | 5/2016 | Mani | G10L 21/0216 379/388.07 |
| 2017/0142262 | A1 | 5/2017 | Sorensen et al. | |

* cited by examiner

METHOD FOR PROCESSING AUDIO SIGNAL AND ELECTRONIC DEVICE FOR SUPPORTING THE SAME

CROSS-REFERENCE TO RELATED APPLICATION(S)

This application is based on and claims priority under 35 U.S.C. § 119(a) of a Korean patent application number 10-2017-0138187, filed on Oct. 24, 2017, in the Korean Intellectual Property Office, the disclosure of which is incorporated by reference herein in its entirety.

BACKGROUND

1. Field

The disclosure relates to a method for processing an audio signal and an electronic device for supporting the same.

2. Description of Related Art

With the growth of information telecommunication technologies, semiconductor technologies, etc., various electronic devices are developing into multimedia devices providing various multimedia services. For example, the electronic devices can provide the various multimedia services such as a broadcasting service, a wireless Internet service, a camera service, a voice reproducing service and the like.

The electronic devices can provide various services related with various audio signals. For example, the electronic device can provide an audio service of using an audio signal collected through a microphone, such as a recording service, a voice recording service during a call, a voice recognition service, a voice message, etc.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a method for processing an audio signal and an electronic device for supporting the same.

In the audio signal related technology, an electronic device transmits an audio signal which has a different output depending on the kind of an audio output device (e.g., a speaker, an earphone, etc.) connected to the electronic device, to the audio output device.

However, the electronic device performs an operation for canceling an echo signal received through the microphone of the electronic device without considering the kind of the audio output device connected to the electronic device, so there is a problem that a quality of an audio service is deteriorated (e.g., echo signal performance degradation, double talk performance degradation, etc.).

Another aspect of the disclosure is to provide a method for processing an audio signal and an electronic device for supporting the same, capable of improving echo cancellation performance, by applying a delay time related with an echo signal and a parameter of a filter which are set differently depending on whether an external cable (e.g., an auxiliary (AUX) cable) connected to a speaker supporting a high output audio signal and having a resistance value of a designated magnitude or more or an external electronic device supporting a relatively low output such as an earphone is connected.

Technological solutions the t disclosure seeks to achieve are not limited to the above-mentioned technological solutions, and other technological solutions not mentioned above would be able to be clearly understood by a person having ordinary skill in the art from the following statement.

For instance, in an embodiment below, a description is made for echo signal cancellation, but a canceled signal is not limited to an echo signal and even reverberation signal cancellation may be included in an embodiment of the disclosure.

Additional aspects will be set forth in part in the description which follows and, in part, will be apparent from the description, or may be learned by practice of the presented embodiments.

In accordance with an aspect of the disclosure, an electronic device is provided. The electronic device includes a communication circuit, at least one microphone, a connector for connecting with an external cable or an external electronic device, and a processor. The processor may be configured to identify whether the external cable connected with a first external electronic device and including a resistor having a resistance value equal to or greater than a designated resistance value is connected to the connector, and in response to identifying that the external cable is connected to the connector, transmit a first audio signal to the first external electronic device through the external cable, and receive a second audio signal including an echo signal which is outputted from the first external electronic device and corresponds to the first audio signal, and a voice signal which is inputted by a user, through the at least one microphone, and cancel the echo signal corresponding to the first audio signal, based at least partly on a delay time corresponding to the external cable and a parameter related with a filter corresponding to the external cable, among a plurality of delay time related with an echo signal and a plurality of parameters related with a filter, which are set to respectively correspond to a second external electronic device and the external cable, the second external electronic device being connectable to the connector and comprising a resistor having a resistance value less than the designated resistance value.

In accordance with another aspect of the disclosure, a method for processing an audio signal is provided. The method includes identifying whether an external cable connected with a first external electronic device and including a resistor having a resistance value equal to or greater than a designated resistance value is connected to a connector, and in response to identifying that the external cable is connected to the connector, transmitting a first audio signal to the first external electronic device through the external cable, and receiving a second audio signal including an echo signal which is outputted from the first external electronic device and corresponds to the first audio signal, and a voice signal which is inputted by a user, through at least one microphone, and canceling the echo signal corresponding to the first audio signal, based at least partly on a delay time corresponding to the external cable and a parameter related with a filter corresponding to the external cable, among a plurality of delay time related with an echo signal and a plurality of parameters related with a filter, which are set to respectively correspond to a second external electronic device and the external cable, the second external electronic device being connectable to the connector and comprising a resistor having a resistance value less than the designated resistance value, and the external cable.

A method for processing an audio signal and an electronic device for supporting the same according to various embodiments of the disclosure may improve an echo cancellation performance by applying a delay time related with an echo signal and a parameter of a filter which are set differently depending on an external electronic device connected to the electronic device.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
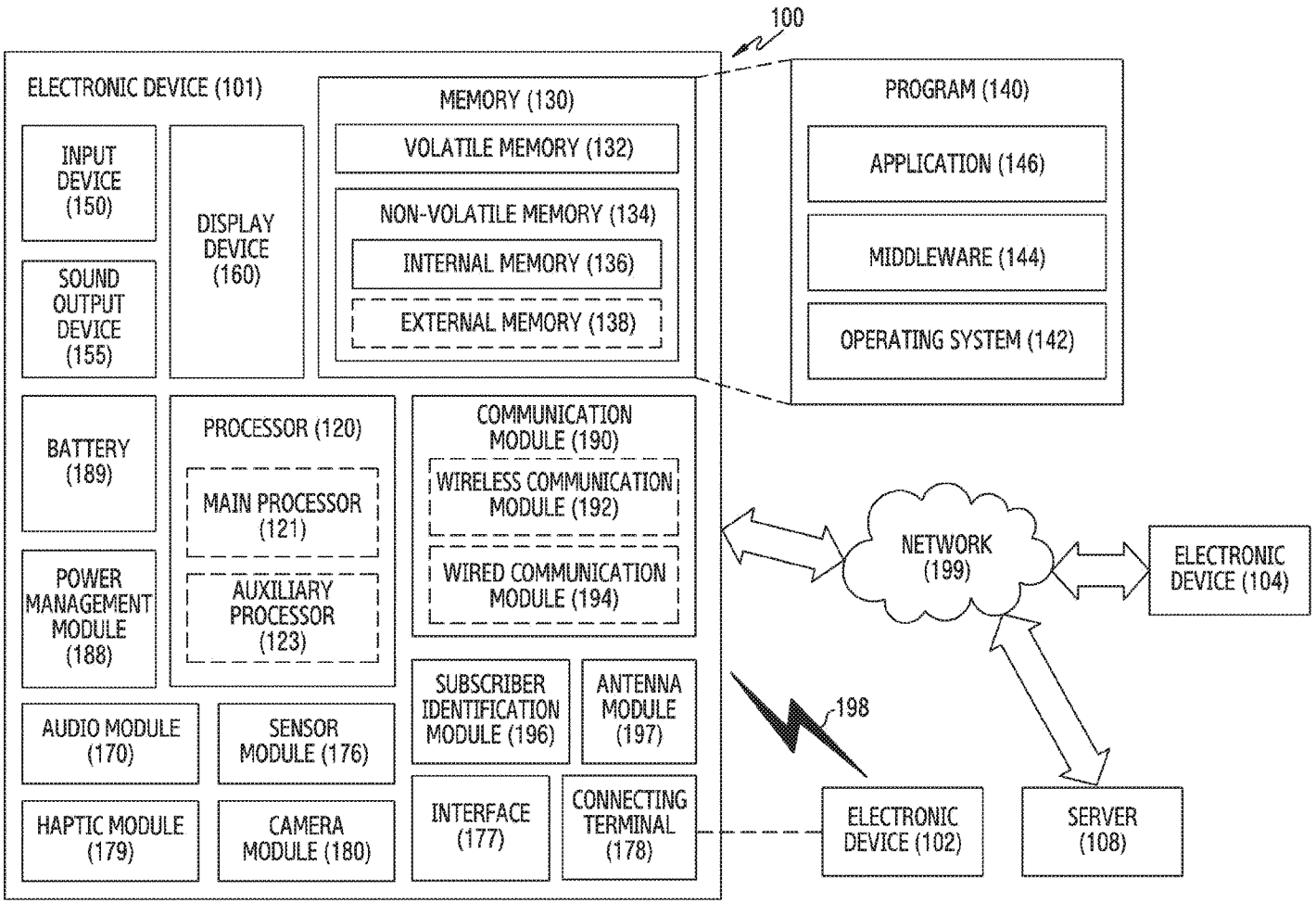
FIG. 1 is a block diagram of an electronic device within a network environment according to an embodiment of the disclosure.

FIG. 1 is a block diagram illustrating an electronic device 101 in a network environment 100 according to an embodiment of the disclosure.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to an embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, or a keyboard.

The sound output device 155 may output sound signals to the outside of the electronic device 101. The sound output device 155 may include, for example, a speaker or a receiver. The speaker may be used for general purposes, such as playing multimedia or playing record, and the receiver may be used for incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to an embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™ wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include one or more antennas, and, therefrom, at least one antenna appropriate for a communication scheme used in the communication network, such as the first network 198 or the second network 199, may be selected, for example, by the communication module 190 (e.g., the wireless communication module 192). The signal or the power may then be transmitted or received between the communication module 190 and the external electronic device via the selected at least one antenna.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

The electronic device according to various embodiments may be one of various types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

Figure 2:
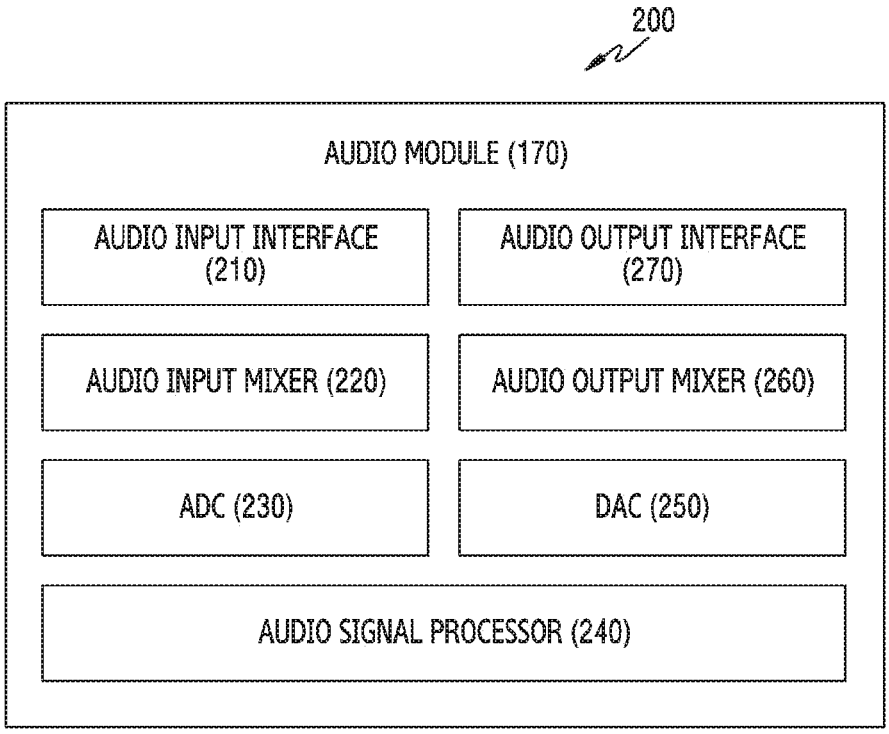
FIG. 2 is a block diagram of an audio module according to an embodiment of the disclosure.

FIG. 2 is a block diagram 200 illustrating the audio module 170 according to an embodiment of the disclosure.

Referring to FIG. 2, the audio module 170 may include, for example, an audio input interface 210, an audio input mixer 220, an analog-to-digital converter (ADC) 230, an audio signal processor 240, a digital-to-analog converter (DAC) 250, an audio output mixer 260, or an audio output interface 270.

The audio input interface 210 may receive an audio signal corresponding to a sound obtained from the outside of the electronic device 101 via a microphone (e.g., a dynamic microphone, a condenser microphone, or a piezo microphone) that is configured as part of the input device 150 or separately from the electronic device 101. For example, if an audio signal is obtained from the external electronic device 102 (e.g., a headset or a microphone), the audio input interface 210 may be connected with the external electronic device 102 directly via the connecting terminal 178, or wirelessly (e.g., Bluetooth™ communication) via the wireless communication module 192 to receive the audio signal. According to an embodiment, the audio input interface 210 may receive a control signal (e.g., a volume adjustment signal received via an input button) related to the audio signal obtained from the external electronic device 102. The audio input interface 210 may include a plurality of audio input channels and may receive a different audio signal via a corresponding one of the plurality of audio input channels, respectively. According to an embodiment, additionally or alternatively, the audio input interface 210 may receive an audio signal from another component (e.g., the processor 120 or the memory 130) of the electronic device 101.

The audio input mixer 220 may synthesize a plurality of inputted audio signals into at least one audio signal. For example, according to an embodiment, the audio input mixer 220 may synthesize a plurality of analog audio signals inputted via the audio input interface 210 into at least one analog audio signal.

The ADC 230 may convert an analog audio signal into a digital audio signal. For example, according to an embodiment, the ADC 230 may convert an analog audio signal received via the audio input interface 210 or, additionally or alternatively, an analog audio signal synthesized via the audio input mixer 220 into a digital audio signal.

The audio signal processor 240 may perform various processing on a digital audio signal received via the ADC 230 or a digital audio signal received from another component of the electronic device 101. For example, according to an embodiment, the audio signal processor 240 may perform changing a sampling rate, applying one or more filters, interpolation processing, amplifying or attenuating a whole or partial frequency bandwidth, noise processing (e.g., attenuating noise or echoes), changing channels (e.g., switching between mono and stereo), mixing, or extracting a specified signal for one or more digital audio signals. According to an embodiment, one or more functions of the audio signal processor 240 may be implemented in the form of an equalizer.

The DAC 250 may convert a digital audio signal into an analog audio signal. For example, according to an embodiment, the DAC 250 may convert a digital audio signal processed by the audio signal processor 240 or a digital audio signal obtained from another component (e.g., the processor (120) or the memory (130)) of the electronic device 101 into an analog audio signal.

The audio output mixer 260 may synthesize a plurality of audio signals, which are to be outputted, into at least one audio signal. For example, according to an embodiment, the audio output mixer 260 may synthesize an analog audio signal converted by the DAC 250 and another analog audio signal (e.g., an analog audio signal received via the audio input interface 210) into at least one analog audio signal.

The audio output interface 270 may output an analog audio signal converted by the DAC 250 or, additionally or alternatively, an analog audio signal synthesized by the audio output mixer 260 to the outside of the electronic device 101 via the sound output device 155. The sound output device 155 may include, for example, a speaker, such as a dynamic driver or a balanced armature driver, or a receiver. According to an embodiment, the sound output device 155 may include a plurality of speakers. In such a case, the audio output interface 270 may output audio signals having a plurality of different channels (e.g., stereo channels or 5.1 channels) via at least some of the plurality of speakers. According to an embodiment, the audio output interface 270 may be connected with the external electronic device 102 (e.g., an external speaker or a headset) directly via the connecting terminal 178 or wirelessly via the wireless communication module 192 to output an audio signal.

According to an embodiment, the audio module 170 may generate, without separately including the audio input mixer 220 or the audio output mixer 260, at least one digital audio signal by synthesizing a plurality of digital audio signals using at least one function of the audio signal processor 240.

According to an embodiment, the audio module 170 may include an audio amplifier (not shown) (e.g., a speaker amplifying circuit) that is capable of amplifying an analog audio signal inputted via the audio input interface 210 or an audio signal that is to be outputted via the audio output interface 270. According to an embodiment, the audio amplifier may be configured as a module separate from the audio module 170.

Figure 3:
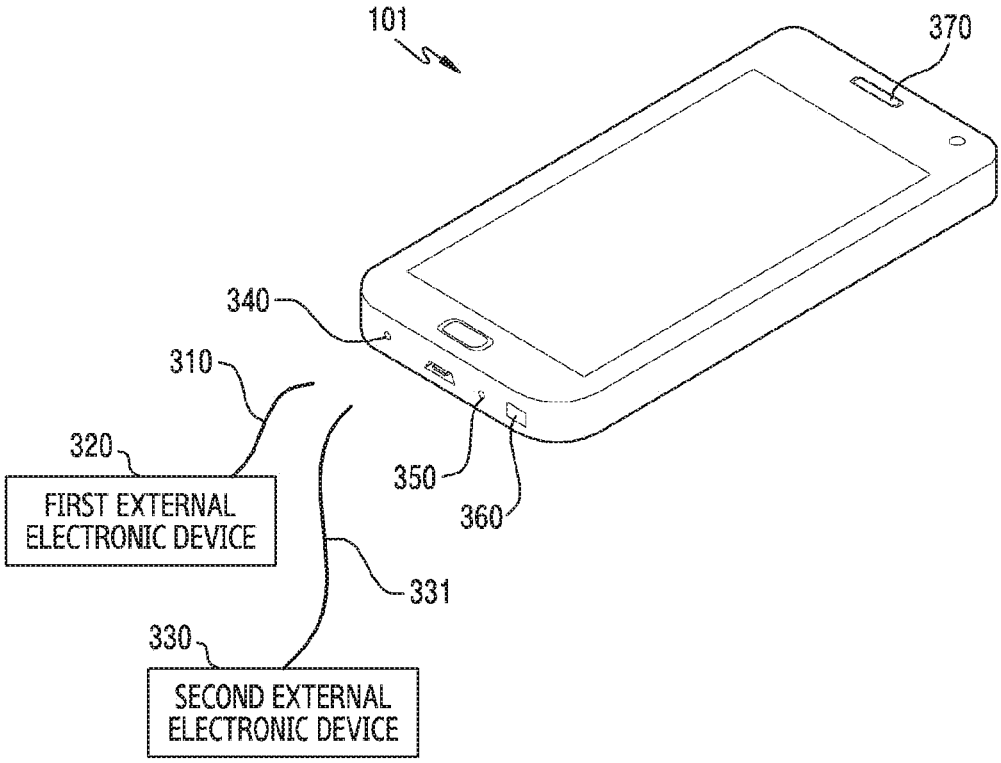
FIG. 3 is a conceptual diagram for explaining a method for processing an audio signal according to an embodiment of the disclosure.

FIG. 3 is a conceptual diagram for explaining a method for processing an audio signal according to an embodiment of the disclosure.

Referring to FIG. 3, in response to the electronic device 101 being connected with a first external electronic device 320 or a second external electronic device 330, the electronic device 101 may transmit an audio signal to the first external electronic device 320 or the second external electronic device 330 such that the first external electronic device 320 or the second external electronic device 330 outputs the audio signal. In an embodiment, the first external electronic device 320 or the second external electronic device 330 may be a device (e.g., a speaker, an earphone or the like) capable of outputting an audio signal.

In an embodiment, the first external electronic device 320 may be connected with a connector 340 (e.g., connecting terminal 178) of the electronic device 101 through an external cable 310 (hereinafter, referred to as an 'external cable') including a resistor having a resistance (or impedance) value (e.g., a resistance value of 1 KΩ or more) of a designated magnitude or more. Hereinafter, an electronic device connected with the connector 340 of the electronic device 101 through the external cable 310 is referred to as a 'first external electronic device'. In an embodiment, the external cable 310 may be an AUX cable (or referred to as an auxiliary cable gender). In an embodiment, the first external electronic device 320 may be an audio output device (e.g., a vehicle speaker device, etc.) capable of outputting an audio signal having a high magnitude (or having a high amplitude) compared to the second external electronic device 330. However, an embodiment is not limited to this, and the first external electronic device 320 may be an audio output device capable of outputting an audio signal having a smaller magnitude than the second external electronic device 330 as well.

In an embodiment, the second external electronic device 330 may be an audio output device (e.g., an earphone, etc.) (hereinafter, referred to as a 'second external electronic device'). The second external electronic device 330 may include a cable 331 capable of including a resistor having a resistance value less than a designated magnitude and being connected with the connector 340 of the electronic device 101, or may be connected with the connector 340 of the electronic device 101 through the cable 331.

In an embodiment, while the electronic device 101 exchanges a voice signal for a call with a counterpart electronic device being communication connected with the electronic device 101 (or while it is connected with the counterpart electronic device through a call application), the electronic device 101 may output the voice signal received from the counterpart electronic device through the first external electronic device 320 or second external electronic device 330 connected to the electronic device 101. The voice signal outputted from the first external electronic device 320 or second external electronic device 330 is an echo signal, and may be introduced (or collected) through a microphone 350 of the electronic device 101, together with a voice signal (or target voice signal) inputted by a user of the electronic device 101.

In another embodiment, while the electronic device 101 executes a voice recognition application and an audio application, the electronic device 101 may output (or reproduce) an audio signal through the first external electronic device 320 or second external electronic device 330 connected to the electronic device 101, by using the audio application. The audio signal outputted through the first external electronic device 320 or the second external electronic device 330 is an echo signal, and may be introduced through the microphone 350 of the electronic device 101, together with a voice signal inputted by the user for the sake of voice recognition.

In a further embodiment, while the electronic device 101 executes a voice record application (or an application for providing a voice message) and an audio application, the electronic device 101 may output (or reproduce) an audio signal through the first external electronic device 320 or second external electronic device 330 connected to the electronic device 101 by using the audio application. The audio signal outputted through the first external electronic device 320 or the second external electronic device 330 is an echo signal, and may be introduced through the microphone 350 of the electronic device 101, together with a voice signal inputted by the user for the sake of voice record (or voice message provision).

In an embodiment, the electronic device 101 may set differently a delay time for canceling an echo signal introduced through the microphone 350, depending on whether the external cable 310 electrically connecting the first external electronic device 320 and the electronic device 101 has been connected to the connector 340 (e.g., the connecting terminal 178) or whether the second external electronic device 330 has been connected to the connector 340. In an embodiment, the delay time may be a time (or parameter) for compensating a delay between an echo signal received from the first external electronic device 320 or second external electronic device 330, and an echo reference signal for filtering out the echo signal. The delay time may be a time which is set to synchronize the echo signal received from the first external electronic device 320 or second external electronic device 330, and the echo reference signal for filtering out the echo signal. The echo reference signal is an audio signal decoded in the processor 120 or the audio module 170, and may be a signal corresponding to the audio signal that will be transmitted to the first external electronic device 320 or the second external electronic device 330. The echo reference signal is a signal corresponding to the echo signal outputted from the first external electronic device 320 or the second external electronic device 330, and may be a signal forwarded to a filter (e.g., a linear filter) filtering out (or modeling) the echo signal. The delay signal may be a time for identifying an echo signal (or an audio frame of the echo signal) required for a filtering operation, together with an echo signal (or an echo reference signal (or an audio frame of the echo reference signal)) corresponding to the echo reference signal. The delay signal may be a time for which the echo reference signal waits for the filtering operation, after the echo reference signal is buffered (or temporarily stored).

In another embodiment, the electronic device 101 may set differently a parameter related with a filter (or the parameter of the filter) for canceling an echo signal introduced through the microphone 350, depending on whether the external cable 310 electrically connecting the first external electronic device 320 and the electronic device 101 has been connected to the connector 340 or whether the second external electronic device 330 has been connected to the connector 340. For example, the electronic device 101 may set differently a parameter related with a non-linear filter for canceling a non-linear component (or non-linear attribute) of an echo signal introduced through the microphone 350, depending on whether the external cable 310 electrically connecting the first external electronic device 320 and the electronic device 101 has been connected to the connector 340 or whether the second external electronic device 330 has been connected to the connector 340. In another example, the electronic device 101 may set differently a parameter related with a non-linear filter for canceling a linear component and non-linear component (or non-linear attribute) of the echo signal introduced through the microphone 350, depending on whether the external cable 310 electrically connecting the first external electronic device 320 and the electronic device 101 has been connected to the connector 340 or whether the second external electronic device 330 has been connected to the connector 340.

In an embodiment, while the electronic device 101 outputs an audio signal by using any one speaker among a plurality of speakers 360 and 370 included in the electronic device 101 in a state in which an external electronic device (e.g., the first external electronic device 320 or second external electronic device 330) is not connected to the electronic device 101, the electronic device 101 may cancel an echo signal, based at least partly on a delay time and a parameter related with a filter which are set corresponding to the speaker outputting the audio signal. For example, the electronic device 101 may set differently a delay time for canceling an echo and a parameter related with a filter to the speaker 360 and the speaker 370. However, an embodiment is not limited to this, and the electronic device 101 may set identically the delay time for canceling the echo and the parameter related with the filter to the speaker and the speaker as well.

An audio processing method and an electronic device according to various embodiments of the disclosure are described below in detail.

Figure 4:
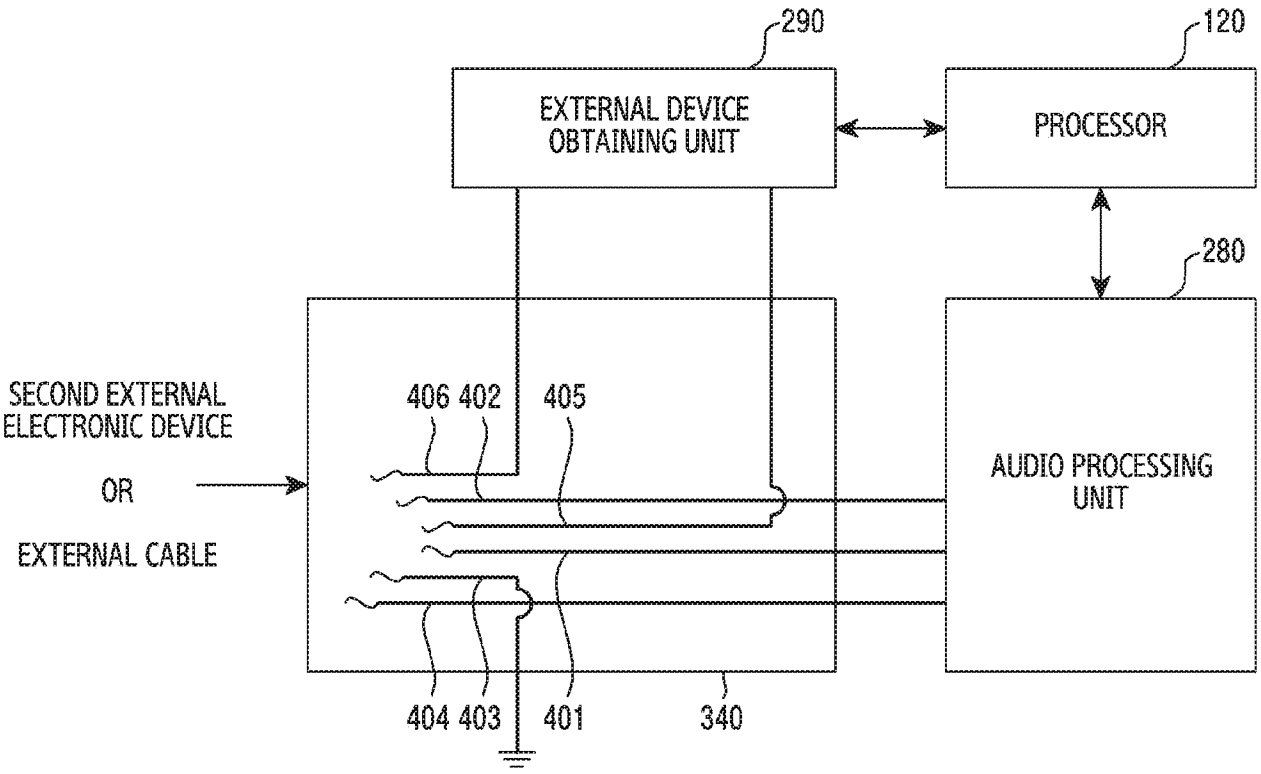
FIG. 4 is a diagram for explaining a method for identifying an external device connected to an electronic device according to an embodiment of the disclosure.

FIG. 4 is a diagram for explaining a method for identifying an external device connected to an electronic device according to an embodiment of the disclosure.

Referring to FIG. 4, the electronic device 101 may include the connector 340, the external device obtaining unit 290, the audio processing unit 280, the processor 120 and the like.

In an embodiment, the connector 340 may include a L terminal 401, a R terminal 402, a G terminal 403 and an M terminal 404 which are connected with an interface of an external device, and an L-DET terminal 405 and a G-DET terminal 406 for identifying the external device that will be connected with the electronic device 101. In an embodiment, the connector 340 may be a 3.5-pi connector (or jack, etc.). However, an embodiment is not limited to this.

In an embodiment, the L terminal 401 may be a terminal for outputting a left sound signal, and the R terminal 402 may be a terminal for outputting a right sound signal, and the M terminal 404 may be a terminal for receiving a microphone signal, and the G terminal 403 may be a ground terminal. In an embodiment, the L terminal 401, the R terminal 402, and the M terminal 404 may be connected with the audio processing unit 280.

In an embodiment, the L-DET terminal 405 and the G-DET terminal 406 may be terminals for obtaining that the external device is connected to the electronic device 101, or identifying the kind of the external device connected to the electronic device 101.

In an embodiment, the external device obtaining unit 290 may apply a current (or referred to as a test current, a small current or the like) (or voltage) for obtaining a connection of the external device to at least one terminal among the L-DET terminal 405 or the G-DET terminal 406 under the control of the processor 120. In an embodiment, the external device obtaining unit 290 may include a construction capable of providing a pulse signal having a designated duty ratio, based at least partly on a control signal received from the processor 120, and a construction for converting the pulse signal into a direct current signal, and a construction for converting a digital signal into an analog signal, and the like. However, an embodiment is not limited to this. In an embodiment, the external device obtaining unit 290 may obtain that the external device is connected to the electronic device 101, by measuring a variation of a resistance (or impedance) value of at least one terminal among the L-DET terminal 405 or the G-DET terminal 406. In an embodiment, the processor 120 may identify that the external device is connected to the electronic device 101, based at least partly on information related with the variation of the resistance (or impedance) value of the at least one terminal among the L-DET terminal 405 or the G-DET terminal 406 acquired from the external device obtaining unit 290. In an embodiment, to prevent the introduction of foreign materials or moisture into the connector 340 from being mistaken as the connection of the external device to the electronic device 101, the processor 120 may identify that the external device is connected to the electronic device 101 only in response to a variation of a resistance value being measured in all of the L-DET terminal 405 and the G-DET terminal 406. However, an embodiment is not limited to this. In an embodiment, although the L-DET terminal 405 is exemplified in FIG. 4, the connector 340 may include, alternatively with the L-DET terminal 405 or additionally to the L-DET terminal 405, a R-DET (not shown) for connecting with an R terminal of an interface of the external device and obtaining a connection of the external device as well.

In an embodiment, in response to it being identified that the external device is connected to the electronic device 101, the external device obtaining unit 290 may apply a current (or referred to as a test current, a small current, or the like) (or voltage) for identifying the external device (or the kind of the external device) to at least one terminal among the L-DET terminal 405 or the G-DET terminal 406 under the control of the processor 120. For example, the external device obtaining unit 290 may identify the external device connected to the electronic device 101, by measuring a resistance (or impedance) value of at least one terminal among the L-DET terminal 405 or the G-DET terminal 406. However, an embodiment is not limited to this, and in response to the external device obtaining unit 290 including the R-DET terminal (not shown), the external device obtaining unit 290 may identify the external device connected to the electronic device 101, by measuring a resistance value of at least one terminal among the R-DET terminal or the L-DET terminal 405. In an embodiment, at least one terminal among the L-DET terminal 405, the G-DET terminal 406 or the R-DET terminal may include a resistor (or test resistor) for identifying the external device connected to the electronic device 101.

In an embodiment, the processor 120 may obtain that the external cable 310 electrically connecting the first external electronic device 320 and the electronic device 101 or the second external electronic device 330 is connected to the electronic device 101, based at least partly on a resistance value (or current, or voltage) obtained through the L-DET terminal 405 or the G-DET terminal 406. In an embodiment, the external cable 310 may include a resistor having a designated resistance value, for example, a resistance value of 1 KΩ or more. The external electronic device (e.g., the first external electronic device 320 or the second external electronic device 330) capable of outputting an audio signal, for example, a speaker (or an interface for connection with the electronic device 101 of the speaker), may include a resistor having a resistance value of a relatively small magnitude such as 16Ω, 32Ω, 128Ω or the like, compared to 1 KΩ In an embodiment, in response to the external cable 310 being connected to the electronic device 101, because the resistance value of the resistor of the external cable 310 is the same (or substantially the same) as a resultant resistance value of the resistance value of the resistor of the external cable 310 and a resistance value of a resistor of the first external electronic device 320 within an error range (or a designated range), the processor 120 may identify that the external cable 310 is connected, regardless of the external electronic device (or the kind of the external electronic device) connected to the external cable 310. In an embodiment, in response to a resistance value (or current or voltage) obtained through the L-DET terminal 405 or the G-DET terminal 406 being obtained less than a designated stored value, the processor 120 may identify that the second external electronic device 330 is connected to the electronic device 101.

In an embodiment, the processor 120 may identify whether an external electronic device (e.g., a 3.5-pi 3-pole earphone) including a 3.5-pi 3-pole terminal (i.e., a L terminal 401, a R terminal 402 and a G terminal 403) is connected as the second external electronic device 330 to the electronic device 101 or whether an external electronic device (e.g., a 3.5-pi 4-pole earphone) including a 3.5-pi 4-pole terminal (i.e., a L terminal 401, a R terminal 402, a G terminal 403 and a M terminal 404) is connected to the electronic device 101. For example, a voltage (e.g., a microphone bias voltage (MIC_Bias)) may be applied to the M terminal 404 of the connector 340 from a power supply unit that is included in the audio processing unit 280 or is constructed independently from the audio processing unit 280. In response to a resistance value of a resistor of the M terminal 404 of the connector 340 and a resistance value of a resistor of the M terminal 404 included in the second external electronic device 330 (or a voltage value measured in the resistor of the M terminal 404 of the connector 340) being measured, the measured resistance values may be forwarded to the audio processing unit 280. The audio processing unit 280 may convert the measured analog resistance values into digital resistance values and forward the digital resistance values to the processor 120. The processor 120 may identify whether the external electronic device connected to the electronic device 101 is the external electronic device including the 3-pole terminal or is the external electronic device including the 4-pole terminal, based at least partly on the resistance values acquired from the audio processing unit 280. In an embodiment, at least a part of the audio processing unit 280 may be included in the audio module 170.

In an embodiment, even though not illustrated in FIG. 4, in response to an application (e.g., a music reproduction application or a call application) for outputting an audio signal being executed in a state in which an external electronic device is not connected to the electronic device 101, the processor 120 may output the audio signal by using any one of the plurality of speakers 360 and 370 included in the electronic device 101, based at least partly on default setting, setting corresponding to an application, or setting by a user input.

Figure 5:
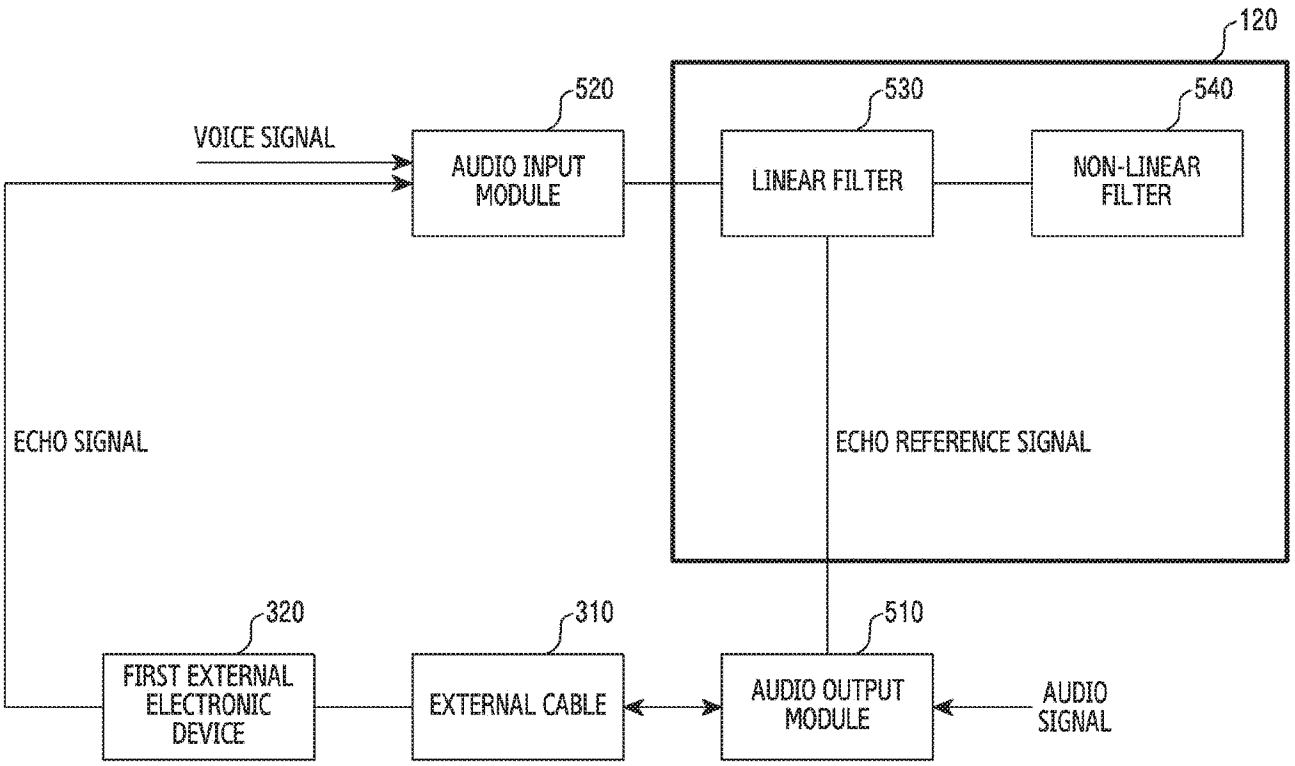
FIG. 5 is a diagram for explaining a method for canceling an echo signal according to an embodiment of the disclosure.

FIG. 5 is a diagram for explaining a method for canceling an echo signal according to an embodiment of the disclosure. For example, FIG. 5 may be a diagram for explaining a method of filtering out an echo signal in response to the external cable 310 being connected to the electronic device 101.

Referring to FIG. 5, the electronic device 101 may include the processor 120 including a linear filter 530 and a non-linear filter 540, an audio output module 510, an audio input module 520 or the like.

In an embodiment, the audio output module 510 may receive an audio signal, and decode the received audio signal. For example, the audio output module 510 may receive an audio signal (e.g., an audio reproduction signal) provided in the electronic device 101, an audio signal received from a counterpart electronic device (e.g., a voice signal received from the counterpart electronic device through a communication module during a call), or the like. However, the audio signal received by the audio output module 510 is not limited to the aforementioned example.

In an embodiment, the audio output module 510 may forward, to the linear filter 530, a decoded audio signal (or a decoded digital audio signal) as an echo reference signal for canceling an echo signal that will be received through the audio input module 520.

In an embodiment, the audio output module 510 may convert the decoded audio signal, for example, the decoded digital audio signal into an analog audio signal. The audio output module 510 may transmit the analog audio signal to the external cable 310.

In an embodiment, in response to the audio signal being outputted from the first external electronic device 320 after being forwarded to the first external electronic device 320 through the external cable 310, the audio signal outputted from the first external electronic device 320 may be introduced (or collected) as an echo signal through the microphone 350. In an embodiment, the echo signal may include a linear component (or a linear signal) of a differentiable form and a non-linear component (or a non-linear signal) not capable of being expressed in a differentiable form. In an embodiment, the non-linear component of the echo signal may be provided by a non-linearity of an element (e.g., the microphone 350, etc.) of the electronic device 101, or be provided by a vibration of the electronic device 101 or an element included in the electronic device 101. In another embodiment, the non-linear component of the echo signal may be provided based at least partly on a non-linearity of the external cable 310 or an element of the first external electronic device 320, an operation of a module performed in the first external electronic device 320, or the like. However, an example of providing the non-linear component of the echo signal is not limited to the aforementioned example. In an embodiment, the non-linear component of the echo signal may be provided in various forms according to a frequency band, a gain of a signal outputted, a mounting state of the microphone 350 of the electronic device 101, or the like. However, an embodiment is not limited to this.

In an embodiment, at least a part of the audio output module 510 may be included in the audio module 170.

In an embodiment, the audio input module 520 may receive a voice signal inputted by a user device, together with an echo signal. In another embodiment, the audio input module 520 may further receive a noise, etc. from a peripheral environment, besides the echo signal and the voice signal inputted by the user device.

In an embodiment, the audio module 170 may include the microphone 350. In an embodiment, at least a part of the audio input module 520 may be included in the audio module 170.

In an embodiment, the processor 120 may perform a filtering operation for canceling an echo signal, based at least partly on a delay time which is set differently depending on an external electronic device connected to the electronic device 101. For example, the processor 120 may perform the filtering operation for canceling the echo signal, by using the delay time which is set differently depending on whether the external cable 310 electrically connecting the first external electronic device 320 and the electronic device 101 has been connected to the connector 340 of the electronic device 101 or whether the second external electronic device 330 has been connected to the connector 340.

In an embodiment, the delay time may be a time (or parameter) for compensating a delay between an echo signal received from the first external electronic device 320 or the second external electronic device 330, and an echo reference signal. In an embodiment, the processor 120 may buffer (or temporarily store) the echo reference signal during the set delay time. In an embodiment, the processor 120 may include a construction for buffering the echo reference signal during the set delay time.

In an embodiment, in response to the external cable 310 being connected to the electronic device 101, a relatively long delay time may be set compared to that the second external electronic device 330 is connected to the electronic device 101. For example, in response to the second external electronic device 330 being connected to the electronic device 101, a time taken to forward a tenth echo reference audio frame to the processor 120 after an audio frame of a first echo reference signal is forwarded to the processor 120 may be set as the delay time (e.g., in response to a frame per second (FPS) at which the audio frame is forwarded being 30, the delay time is set as ⅓ seconds). In response to the external cable 310 being connected to the electronic device 101, a time taken to forward one hundred tenth echo reference audio frame to the processor 120 after the audio frame of the first echo reference signal is forwarded to the processor 120 may be set as the delay time (e.g., in response to an FPS at which the audio frame is forwarded being 30, the delay time is set as 11/3 seconds).

In an embodiment, the processor 120 may filter out a linear component of an echo by using the linear filter 530. In an embodiment, the linear filter 530 may include an adaptive filter employing at least one algorithm among a normalized least mean square (NLMS), affine projection (AP), or recursive least square (RLS). However, the linear filter 530 is not limited to the aforementioned example.

In an embodiment, a parameter related with the linear filter 530 may be set identically regardless of whether the external cable 310 electrically connecting the first external electronic device 320 and the electronic device 101 has been connected to the connector 340 of the electronic device 101 or whether the second external electronic device 330 has been connected to the connector 340. However, an embodiment is not limited to this. A parameter related with the linear filter 530 may be set differently depending on whether the external cable 310 electrically connecting the first external electronic device 320 and the electronic device 101 has been connected to the connector 340 of the electronic device 101 or whether the second external electronic device 330 has been connected to the connector 340 as well.

In an embodiment, the linear filter 530 may model a signal reflecting an attribute of a linear component of an echo reference signal, based at least partly on the echo reference signal. In an embodiment, after filtering out (or canceling) a linear component of the echo component, the linear filter 530 may forward the echo signal whose linear component is canceled to the non-linear filter 540. In an embodiment, the linear filter 530 may forward an echo reference signal for filtering out a non-linear component of the echo signal to the non-linear filter 540, together with the echo signal whose linear component is canceled. In an embodiment, the echo reference signal for filtering out the non-linear component of the echo signal may be directly forwarded to the non-linear filter 540 from the audio output module 510.

In an embodiment, by using the non-linear filter 540, the processor 120 may filter out the non-linear component of the echo signal. In an embodiment, the non-linear filter 540 may use an algorithm related with a sigmoid function. However, an algorithm that the non-linear filter 540 uses to filter out the non-linear component of the echo signal is not limited to the aforementioned example.

In an embodiment, the parameter related with the non-linear filter 540 may be set differently depending on a device connected to the electronic device 101. For example, in response to the external cable 310 being connected to the electronic device 101, the parameter (or echo signal cancellation level or echo signal cancellation strength) related with the non-linear filter 540 may be set greater (or higher) (e.g., be set larger 12 to 16 times), compared to that the second external electronic device 330 is connected to the electronic device 101.

In an embodiment, the non-linear filter 540 may model a signal reflecting an attribute of a non-linear component of an echo reference signal, based at least partly on the echo reference signal. In an embodiment, though not illustrated in FIG. 5, after filtering out (or canceling) a non-linear component of an echo component by using the non-linear filter 540, the processor 120 may further perform a filtering operation for canceling a noise.

In an embodiment, after filtering out an echo signal by using the linear filter 530 and the non-linear filter 540, the processor 120 may perform various operations (or functions) by using a voice signal. For example, while a call application is executed, the processor 120 may forward a voice signal to a counterpart electronic device. In another example, while a voice recognition application is executed, the processor 120 may perform an operation for recognizing by using a voice signal. In a further example, while a voice record application is executed, the processor 120 may perform an operation for recording (or storing) a voice signal. However, various operations (or functions) carried out after the echo signal is filtered out are not limited to the aforementioned example.

In an embodiment, it is illustrated that the linear filter 530 and the non-linear filter 540 are included in the processor 210, but an embodiment is not limited to this. For example, the linear filter 530 and the non-linear filter 540 may be included in the audio module 170, or may be included in the electronic device 101 as a construction independent from the processor 120 and the audio module 170.

Figure 6:
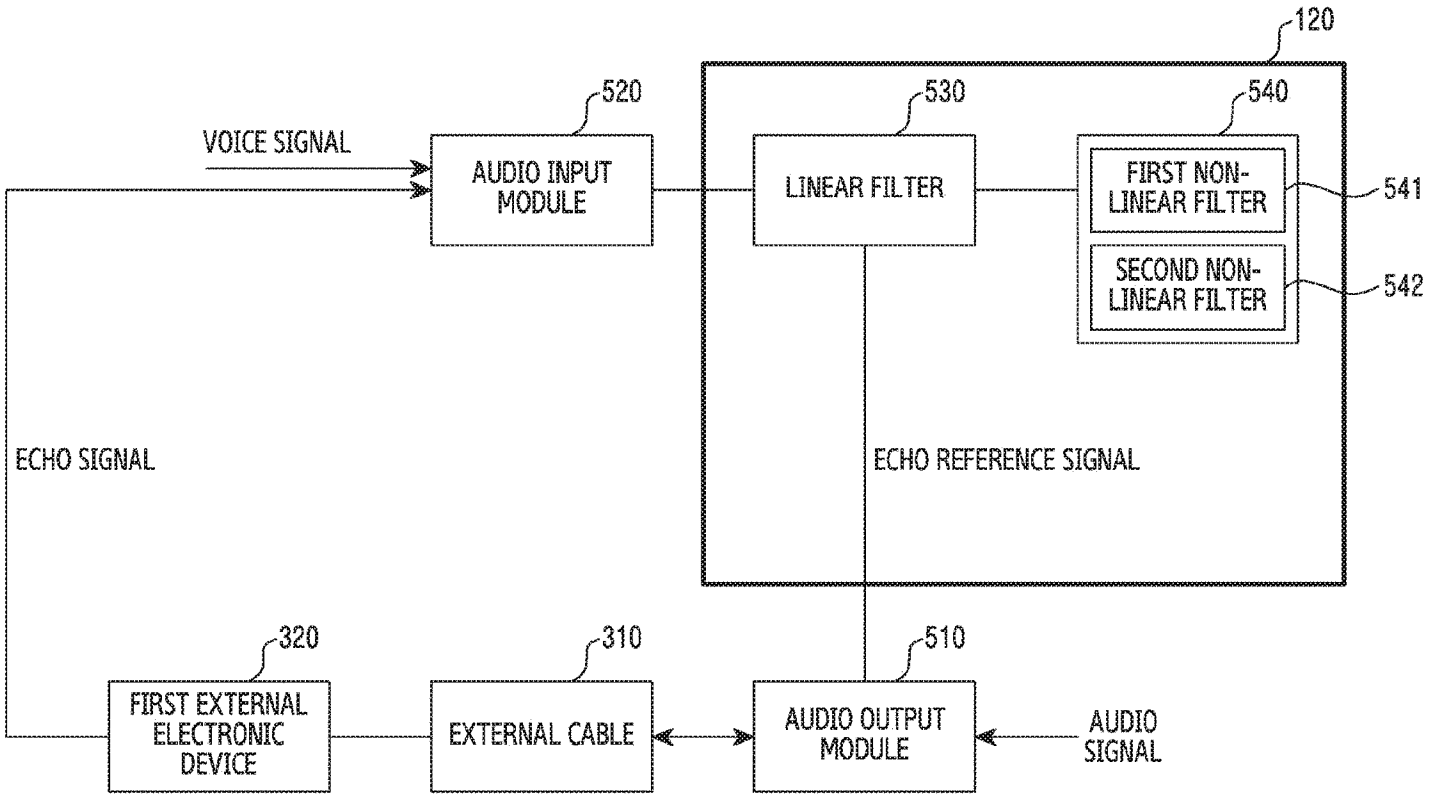
FIG. 6 is a diagram for explaining a method for canceling an echo signal according to an embodiment of the disclosure.

FIG. 6 is a diagram for explaining a method for canceling an echo signal according to an embodiment of the disclosure. For example, FIG. 6 is a diagram for explaining a method for canceling a non-linear component of an echo signal.

Referring to FIG. 5 and FIG. 6, a non-linear filter 540 of FIG. 6 may include a plurality of non-linear filters 540, for example, a first non-linear filter 541 and a second non-linear filter 542.

In various embodiments, FIG. 6 is at least partially the same or similar with FIG. 5 and therefore, a duplicated description is omitted.

In an embodiment, a non-linear component of an echo signal may be provided by a non-linearity of an element (e.g., the microphone 350, etc.) of the electronic device 101, or be provided by a vibration of the electronic device 101 or an element included in the electronic device 101. In another embodiment, the non-linear component of the echo signal may be provided based at least partly on a non-linearity of the external cable 310 or an element of the first external electronic device 320, an operation of a module performed in the first external electronic device 320, or the like. However, an example of providing the non-linear component of the echo signal is not limited to the aforementioned example. In an embodiment, the non-linear component of the echo signal may be provided in various forms according to a frequency band, a gain of a signal outputted, a mounting state of the microphone 350 of the electronic device 101, or the like. However, an embodiment is not limited to this.

In an embodiment, to filter out a non-linear component having various attributes (or forms) of an echo signal, the non-linear filter 540 may include the plurality of non-linear filters 541 and 542. For example, the first non-linear filter 541 may filter out a non-linear component having a first attribute of the echo signal. The second non-linear filter 542 may filter out a non-linear component having a second attribute of the echo signal. FIG. 6 exemplifies that the non-linear filter 540 includes the two non-linear filters 541 and 542, but is not limited to this and may include three or more non-linear filters as well.

In an embodiment, in response to the external cable 310 being connected to the electronic device 101, more non-linear filters for canceling an echo signal may be used (or more non-linear filters may perform a filtering operation), compared to that the second external electronic device 330 is connected to the electronic device 101. For example, in response to the second external electronic device 330 being connected to the electronic device 101, only the first non-linear filter 541 may be used to filter out the non-linear component of the echo signal. In response to the external cable 310 being connected to the electronic device 101, the first non-linear filter 541 and the second non-linear filter 542 may be used to filter out the non-linear component of the echo signal.

In an embodiment, the non-linear filter 540 may use the algorithm related with the sigmoid function.

The sigmoid function may be identified as in Equation below.

$$\text{sigmoid}(x) = \frac{2b}{1 + e^{-ax}} - b \qquad \text{Equation 1}$$

Herein, the sigmoid (x) refers the sigmoid function, and the 'e' refers an irrational number 'e' that is an approximate value 2.718281828 . . . being a base of the natural logarithm, and the 'a' and 'b' refer arbitrary numbers. Through the 'a' and 'b', an attribute of the sigmoid function may be identified. The 'a' and 'b' may be parameters of the sigmoid function.

In an embodiment, the plurality of non-linear filters 540 each may be expressed by a different sigmoid function. In an embodiment, in the first non-linear filter 541 and the second non-linear filter 542, the 'a' and 'b' may be set differently (or applied). For example, the 'a' of the first non-linear filter 541 may be set as 2.5, and the 'b' may be set as 1, and the 'a' of the second non-linear filter 542 may be set as 4, and the 'b' may be set as 0.5. However, the aforementioned numbers of the 'a' and 'b' are an example, and an embodiment is not limited to this.

In an embodiment, in response to the non-liner filter 540 including one non-linear filter 540, a parameter related with the non-linear filter 540 may be set differently depending on an external electronic device connected to the electronic device 101. For example, in response to the non-linear filter 540 using the algorithm related with the sigmoid function, the 'a' and 'b' may be set differently (or applied) depending on whether the external cable 310 is connected to the electronic device 101 or whether the second external electronic device 330 is connected to the electronic device 101. For example, in response to the external cable 310 being connected to the electronic device 101, the 'a' of the non-linear filter 540 may be set as 4, and the 'b' may be set as 0.5 and, in response to the second external electronic device 330 being connected to the electronic device 101, the 'a' may be set as 2.5, and the 'b' may be set as 1. However, the aforementioned numbers of the 'a' and 'b' are an example, and an embodiment is not limited to this.

An electronic device according to various embodiments of the disclosure may include a communication circuit, at least one microphone, a connector for connecting with an external cable or an external electronic device, and a processor. The processor may be configured to identify whether the external cable including a resistor having a resistance value of a designated magnitude or more and connecting with a first external electronic device is connected to the connector, and in response to identifying that the external cable is connected to the connector, transmit a first audio signal to the first external electronic device through the external cable, and receive a second audio signal including an echo signal which is outputted from the first external electronic device and corresponds to the first audio signal, and a voice signal which is inputted by a user, through the at least one microphone, and cancel the echo signal corresponding to the first audio signal, based at least partly on a delay time corresponding to the external cable and a parameter related with a filter corresponding to the external cable, among a plurality of delay time related with an echo signal and a plurality of parameters related with a filter, which are set to correspond to each of a second external electronic device being connectable to the connector and including a resistor having a resistance value less than the designated magnitude, and the external cable.

In various embodiments, the processor may be configured to identify that the external device is connected to the connector, and in response to identifying that the external device is connected to the connector, identify whether the external device is the external cable or is the second external electronic device.

In various embodiments, the second external electronic device may include an external electronic device including a 3-pole terminal or an external electronic device including a 4-pole terminal, and the processor may be configured to, in response to identifying that the external electronic device is connected to the connector, identify whether the external electronic device is the external cable, or is the external electronic device including the 3-pole terminal, or is the external electronic device including the 4-pole terminal.

In various embodiments, the electronic device may further include a plurality of speakers, and the processor may be configured to in response to identifying that the external device is not connected to the connector, while outputting an audio signal through one speaker among the plurality of speakers, receive, through the at least one microphone, an echo signal outputted form the one speaker and a voice signal inputted to a user, and cancel an echo signal outputted from the one speaker, based at least partly on a delay time corresponding to the one speaker and a parameter related with a filter corresponding to the one speaker, among a plurality of delay time related with an echo signal and a plurality of parameters related with the filter, which are set to correspond to the plurality of speakers respectively.

In various embodiments, the filter may include a linear filter and a non-linear filter, and the processor may be configured to cancel an echo signal corresponding to the first audio signal, based at least partly on a delay time and a parameter related with at least one of the linear filter or the non-linear filter, which correspond to the external cable.

In various embodiments, the delay time corresponding to the external cable may be set long compared to the delay time corresponding to the second external electronic device.

In various embodiments, the parameter related with the non-linear filter corresponding to the external cable may be set to apply a greater echo signal cancellation level to the echo signal, compared to a parameter related with a non-linear filter corresponding to the second external electronic device.

In various embodiments, in response to the non-linear filter including a plurality of non-linear parameters, the processor may be configured to cancel a non-linear echo component of the echo signal by using more non-linear parameters among the plurality of non-linear parameters, in response to the external cable being connected to the connector, compared to the second external electronic device being connected to the connector.

In various embodiments, the external cable may include an auxiliary cable.

In various embodiments, the processor may be configured to transmit the first audio signal to the first external electronic device through the external cable during the execution of a call application, a voice recognition application, an audio reproduction application or an application for providing a voice message.

Figure 7:
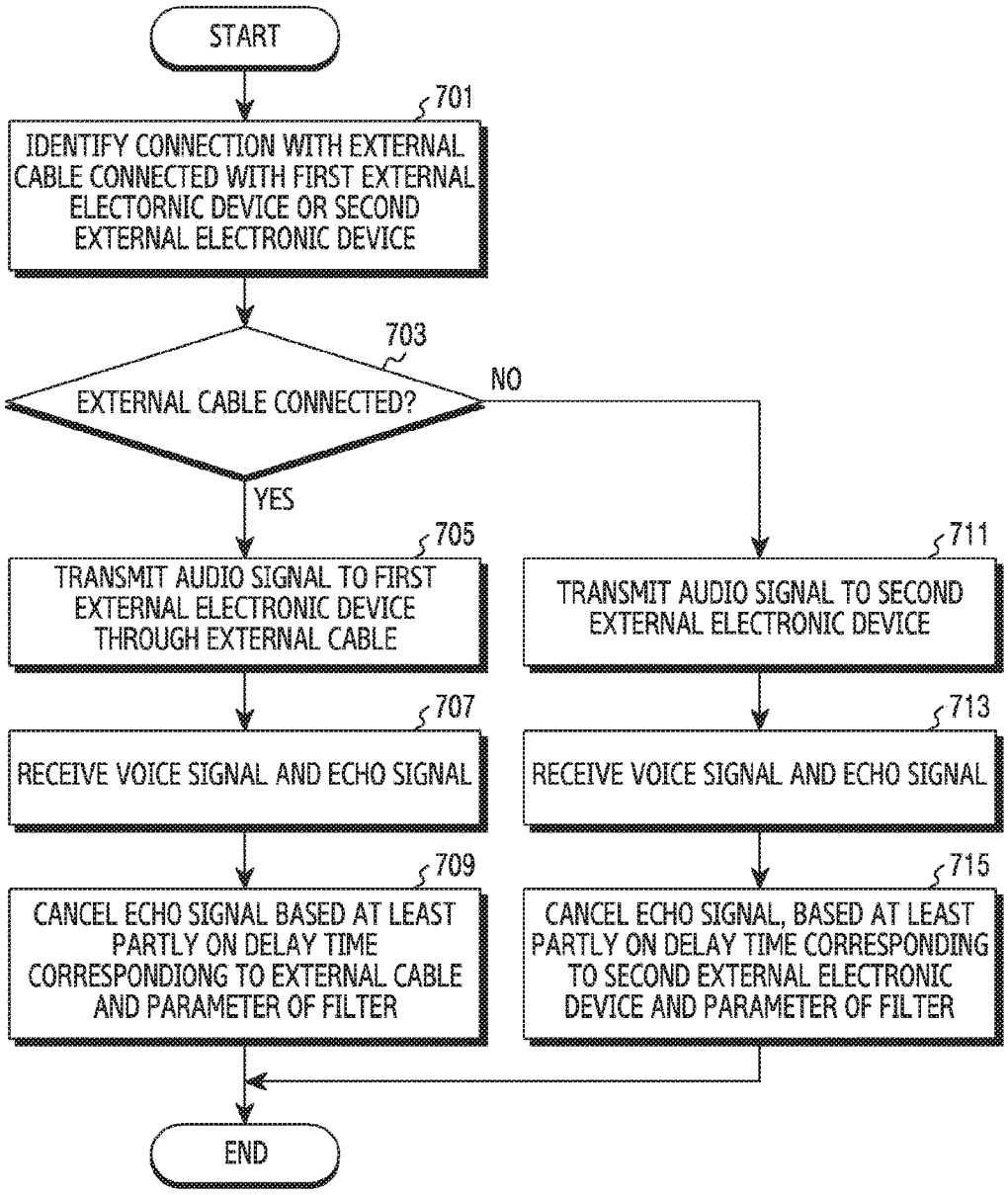
FIG. 7 is a diagram for explaining a method for processing an audio signal according to an embodiment of the disclosure.

FIG. 7 is a diagram for explaining a method for processing an audio signal according to an embodiment of the disclosure.

Referring to FIG. 7, in operation 701 the processor 120 may identify whether the external cable 310 connected with the first external electronic device 320 is connected to the electronic device 101 (or the connector 340 of the electronic device 101) or whether the second external electronic device 330 is connected to the electronic device 101. In an embodiment, the external cable 310 may be a cable including a resistor having a resistance (or impedance) value of a designated magnitude or more (e.g., a resistance value of 1 KΩ or more). In an embodiment, the external cable 310 may be an AUX cable (or referred to as an auxiliary cable gender).

The operation 701 of identifying whether the external cable 310 is connected to the electronic device 101 or whether the second external electronic device 330 is connected to the electronic device 101 is described in detail with reference to FIG. 8.

Figure 8:
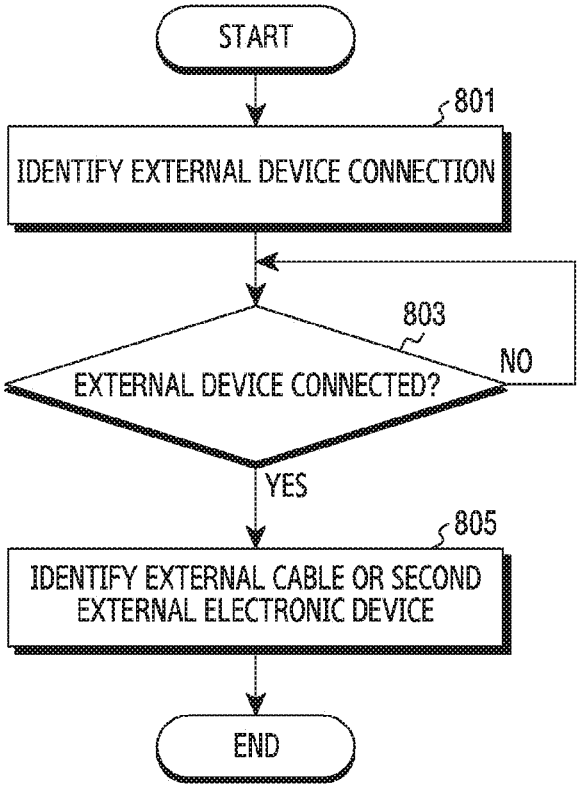
FIG. 8 is a diagram for explaining a method for identifying an external device connected to an electronic device according to an embodiment of the disclosure.

FIG. 8 is a diagram for explaining a method for identifying an external device connected to an electronic device according to an embodiment of the disclosure.

Referring to FIG. 8, in operation 801 the processor 120 may obtain that the external device is connected to the electronic device 101.

In an embodiment, the processor 120 may apply a current (or referred to as a test current, a small current, or the like) (or voltage) for obtaining the connection of the external device to at least one terminal among the L-DET terminal 405 or G-DET terminal 406 included in the connector 340 by using the external device obtaining unit 290. In an embodiment, the connector 340 may be a 3.5-pi connector (or jack, etc.). However, an embodiment is not limited to this. In an embodiment, the L-DET terminal 405 and the G-DET terminal 406 may be terminals for obtaining that the external device is connected to the electronic device 101 or identifying the kind of the external device connected to the electronic device 101.

In an embodiment, the external device obtaining unit 290 may include a construction capable of providing a pulse signal having a designated duty ratio based at least partly on a control signal received from the processor 120, and a construction for converting the pulse signal into a direct current signal, and a construction for converting a digital signal into an analog signal, and the like. However, an embodiment is not limited to this.

In an embodiment, the processor 120 may obtain that the external device is connected to the electronic device 101, by measuring a variation of a resistance (or impedance) value of at least one terminal among the L-DET terminal 405 or the G-DET terminal 406 by using the external device obtaining unit 290.

In an embodiment, the processor 120 may identify that the external device is connected to the electronic device 101, based at least partly on information related with the variation of the resistance (or impedance) value of the at least one terminal among the L-DET terminal 405 or G-DET terminal 406 acquired from the external device obtaining unit 290.

In an embodiment, to prevent the introduction of foreign materials or moisture into the connector 340 from being mistaken as the connection of the external device to the electronic device 101, the processor 120 may identify that the external device is connected to the electronic device 101 only in response to a variation of a resistance value being measured in all of the L-DET terminal 405 and the G-DET terminal 406. However, an embodiment is not limited to this.

In operation 803, in response to the processor 120 identifying that the external device is not connected to the electronic device 101, the processor 120 may perform an operation for obtaining that the external device is connected to the electronic device 101 at a designated time interval (or at a designated period). However, an embodiment is not limited to this.

In operation 805, in response to the processor 120 identifying that the external device is connected to the electronic device 101 in operation 803, the processor 120 may identify the external device (or the kind of the external device) (e.g., the external cable 310 or the second external electronic device 330) connected to the electronic device 101.

In an embodiment, the processor 120 may apply a current (or referred to as a test current, a small current, or the like) (or voltage) for identifying the external device (or the kind of the external device) to at least one terminal among the L-DET terminal 405 or the G-DET terminal 406 by using the external device obtaining unit 290. For example, the processor 120 may identify the external device connected to the electronic device 101, by measuring a resistance (or impedance) value of at least one terminal among the L-DET terminal 405 or the G-DET terminal 406 by using the external device obtaining unit 290. However, an embodiment is not limited to this.

In an embodiment, the processor 120 may identify whether an external electronic device (e.g., a 3.5-pi 3-pole earphone) including a 3.5-pi 3-pole terminal (i.e., a L terminal 401, a R terminal 402 and a G terminal 403) is connected as the second external electronic device 330 to the electronic device 101 or whether an external electronic device (e.g., a 3.5-pi 4-pole earphone) including a 3.5-pi 4-pole terminal (i.e., a L terminal 401, a R terminal 402, a G terminal 403 and a M terminal 404) is connected to the electronic device 101. For example, a voltage (e.g., a microphone bias voltage (MIC_Bias) may be applied to the M terminal 404 of the connector 340 from a power supply unit that is included in the audio processing unit 280 or is constructed independently from the audio processing unit 280. In response to a resistance value of a resistor of the M terminal 404 of the connector 340 and a resistance value of a resistor of the M terminal included in the second external electronic device 330 (or a voltage value measured in the resistor of the M terminal 404 of the connector 340) being measured, the measured resistance values may be forwarded to the audio processing unit 280. The audio processing unit 280 may convert the measured analog resistance values into digital resistance values and forward the digital resistance values to the processor 120. The processor 120 may identify whether the external device connected to the electronic device 101 is the external electronic device including the 3-pole terminal or is the external electronic device including the 4-pole terminal, based at least partly on the resistance value acquired from the audio processing unit 280. In an embodiment, at least a part of the audio processing unit 280 may be included in the audio module 170.

Returning to FIG. 7, in response to the processor 120 identifying that the external cable 310 is connected to the electronic device 101 in operation 703, in operation 705, the processor 120 may transmit an audio signal to the first external electronic device 320 through the external cable 310.

In various embodiments, though not illustrated in FIG. 7, the electronic device 101 may acquire (or provide, or reproduce, or receive, or the like) an audio signal by various inputs. For example, in response to a call application being executed in the electronic device 101, the electronic device 101 may receive a voice signal from a counterpart electronic device. In another example, while a music (or audio) application is executed in the electronic device 101, the electronic device 101 may provide an audio signal. However, an example of acquiring an audio signal (or voice signal) in the electronic device 101 is not limited to the aforementioned example.

In an embodiment, in response to the processor 120 identifying that the external cable 310 is connected to the electronic device 101 while the electronic device 101 acquires an audio signal (or after the electronic device 101 acquires the audio signal), the processor 120 may enable to transmit the acquired audio signal to the first external electronic device 320 through the external cable 310. For example, in response or automatically to identifying that the external cable 310 is connected to the electronic device 101, the processor 120 may enable to transmit the acquired audio signal to the first external electronic device 320 through the external cable 310. In another example, after identifying that the external cable 310 is connected to the electronic device 101, the processor 120 may enable to transmit the acquired audio signal to the first external electronic device 320 through the external cable 310, based at least partly on at least one of default setting (or user setting) or a user input.

In another embodiment, in response to the electronic device 101 acquiring an audio signal after the processor 120 identifies that the external cable 310 is connected to the electronic device 101, the processor 120 may enable to transmit the acquired audio signal to the first external electronic device 320 through the external cable 310. For example, in response (or automatically) to the electronic device 101 acquiring an audio signal after the processor 120 identifies that the external cable 310 is connected to the electronic device 101, the processor 120 may enable to transmit the acquired audio signal to the first external electronic device 320 through the external cable 310. In another example, after identifying that the external cable 310 is connected to the electronic device 101, the processor 120 may enable to transmit the acquired audio signal to the first external electronic device 320 through the external cable 310, based at least partly on at least one of default setting (or user setting) or a user input.

In operation 707, the processor 120 may receive a voice signal inputted by a user and an echo signal outputted to the first external electronic device 320, through the audio input module 520 (e.g., the microphone 350).

In an embodiment, the processor 120 may further receive a noise, etc., besides the voice signal inputted by the user and the echo signal outputted to the first external electronic device 320. In an embodiment, though not illustrated in FIG. 7, the processor 120 may further receive an echo reference signal for filtering out the echo signal, besides the voice signal and the echo signal.

In operation 709, the processor 120 may cancel the echo signal, based at least partly on a delay time corresponding to the external cable 310 and a parameter related with a filter.

The operation 709 of canceling the echo signal based at least partly on the delay time corresponding to the external cable 310 and the parameter related with the filter corresponding to the external cable 310 is described in detail with reference to FIG. 9.

Figure 9:
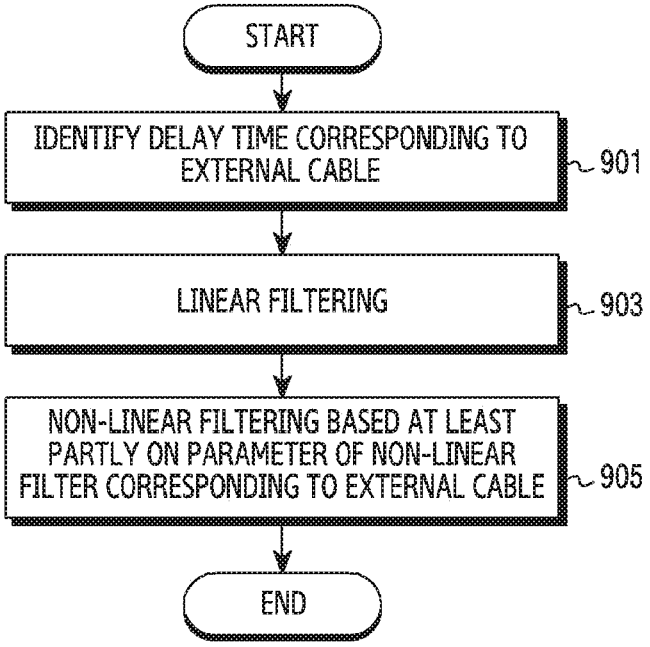
FIG. 9 is a diagram for explaining a method for canceling an echo signal according to an embodiment of the disclosure.

FIG. 9 is a diagram for explaining a method for canceling an echo signal according to an embodiment of the disclosure.

Referring to FIG. 9, in operation 901 the processor 120 may identify a delay time corresponding to the external cable 310. For example, in response to the external cable 310 being connected, the processor 120 may identify a delay time which is set to perform a filtering operation.

In an embodiment, the delay time may be a time (or parameter) for compensating a delay between an echo signal received from the first external electronic device 320, and an echo reference signal. In an embodiment, the processor 120 may buffer (or temporarily store) the echo reference signal during the delay time which is set corresponding to the external cable 310. In an embodiment, the processor 120 may include a construction for buffering the echo reference signal during the set delay time.

In an embodiment, in response to the external cable 319 being connected to the electronic device 101, a relatively long delay time may be set compared to that the second external electronic device 330 is connected to the electronic device 101.

In operation 903, the processor 120 may perform a linear filtering operation by using the linear filter 530.

In an embodiment, the processor 120 may filter out a linear component of an echo signal outputted from the first external electronic device 320 by using the linear filter 530. In an embodiment, the linear filter 530 may include an adaptive filter employing at least one algorithm among a normalized least mean square (NLMS), affine projection (AP), or recursive least square (RLS). However, the linear filter 530 is not limited to the aforementioned example.

In an embodiment, a parameter related with the linear filter 530 may be set identically regardless of whether the external cable 310 electrically connecting the first external electronic device 320 and the electronic device 101 has been connected to the connector 340 of the electronic device 101 or whether the second external electronic device 330 has been connected to the connector 340. However, an embodiment is not limited to this. The parameter of the linear filter 530 may be set differently depending on whether the external cable 310 electrically connecting the first external electronic device 320 and the electronic device 101 has been connected to the connector 340 of the electronic device 101 or whether the second external electronic device 330 has been connected to the connector 340 as well.

In an embodiment, the linear filter 530 may model a signal reflecting an attribute of a linear component of an echo reference signal, based at least partly on the echo reference signal. In an embodiment, after filtering out (or canceling) a linear component of an echo component, the linear filter 530 may forward the echo signal whose linear component is canceled to the non-linear filter 540.

In an embodiment, the linear filter 530 may forward an echo reference signal for filtering out a non-linear component of an echo signal to the non-linear filter 540, together with the echo signal whose linear component is canceled. In an embodiment, the echo reference signal for filtering out the non-linear component of the echo signal may be directly forwarded from the audio output module 510 to the non-linear filter 540.

In operation 905, the processor 120 may perform a non-linear filtering operation for filtering out a non-linear component of an echo signal outputted from the first external electronic device 320, based at least partly on a parameter related with the non-linear filter 540 corresponding to the external cable 310.

In an embodiment, the non-linear filter 540 may use the algorithm related with the sigmoid function. However, the algorithm that the non-linear filter 540 uses to filter out the non-linear component of the echo signal is not limited to the aforementioned example.

In an embodiment, the parameter related with the non-linear filter 540 may be set differently depending on an external electronic device connected to the electronic device 101. For example, in response to the external cable 310 being connected to the electronic device 101, the parameter (or echo signal cancellation level or echo signal cancellation strength) related with the non-linear filter 540 may be set greater (or higher) (e.g., be set larger 12 to 16 times) compared to that the second external electronic device 330 is connected to the electronic device 101.

In an embodiment, the non-linear filter 540 may model a signal reflecting an attribute of a non-linear component of an echo reference signal, based at least partly on the echo reference signal.

In an embodiment, to filter out a non-linear component having various attributes (or forms) of an echo signal, the non-linear filter 540 may include the plurality of non-linear filters 540.

In an embodiment, in response to the external cable 310 being connected to the electronic device 101, more non-linear filters 540 for canceling an echo signal may be used (or more non-linear filters 540 may perform a filtering operation), compared to that the second external electronic device 330 is connected to the electronic device 101.

In an embodiment, the non-linear filter 540 may use the algorithm related with the sigmoid function. However, the algorithm used by the non-linear filter 540 is not limited to the sigmoid function.

In an embodiment, in response to the non-liner filter 540 including one non-linear filter 540, a parameter related with the non-linear filter 540 may be set differently depending on an external electronic device connected to the electronic device 101.

Returning to FIG. 7, in operation 711, in response to the processor 120 identifying that the second external electronic device 330 is connected to the electronic device 101 in operation 703, the processor 120 may transmit an audio signal to the second external electronic device 330.

In various embodiments, at least part of operation 711 is the same or similar with at least part of operation 705 and therefore, its detailed description is omitted.

In operation 713, the processor 120 may receive a voice signal inputted by a user and an echo signal outputted to the first external electronic device 330, through the audio input module 520 (e.g., the microphone 350).

In an embodiment, the processor 120 may further receive a noise, etc., besides the voice signal inputted by the user and the echo signal outputted to the first external electronic device 330. In an embodiment, though not illustrated in FIG. 7, the processor 120 may further receive an echo reference signal for filtering out an echo signal, besides the voice signal and the echo signal.

In operation 715, the processor 120 may cancel the echo signal, based at least partly on a delay time corresponding to the second external electronic device 330 and a parameter related with a filter corresponding to the second external electronic device 330.

In various embodiments, at least part of operation 715 is the same or similar with at least part of operation 709 and therefore, its detailed description is omitted.

In an embodiment, the processor 120 may identify the delay time corresponding to the second electronic device 101. For example, in response to the second electronic device 101 being connected to the electronic device 101, the processor 120 may identify a delay time which is set to perform a filtering operation.

In an embodiment, the delay time may be a time (or parameter) for compensating a delay between an echo signal received from the second external electronic device 330, and an echo reference signal.

In an embodiment, in response to the second electronic device 101 being connected to the electronic device 101, a relatively short delay time may be set compared to that the external cable 310 is connected to the electronic device 101.

In an embodiment, the processor 120 may filter out a linear component of an echo signal outputted from the second external electronic device 330 by using the linear filter 530.

In an embodiment, the processor 120 may perform a non-linear filtering operation for filtering out a non-linear component of an echo signal outputted from the second external electronic device 330, based at least partly on a parameter of the non-linear filter 540 corresponding to the external cable 310.

In an embodiment, in response to the second external electronic device 330 being connected to the electronic device 101, a parameter (or echo signal cancellation level or echo signal cancellation strength) of the non-linear filter 540 may be set smaller (or lower), compared to that the external cable 310 being connected to the electronic device 101.

In an embodiment, though not illustrated in FIG. 9, after filtering out (or canceling) a non-linear component of an echo component by using the non-linear filter 540, the processor 120 may further perform a filtering operation for canceling a noise.

In an embodiment, after filtering out an echo signal by using the linear filter 530 and the non-linear filter 540, the processor 120 may perform various operations (or functions) by using a voice signal. For example, while a call application is executed, the processor 120 may forward the voice signal to a counterpart electronic device. In another example, while a voice recognition application is executed, the processor 120 may perform an operation for recognizing by using a voice signal. In a further example, while a voice record application is executed, the processor 120 may perform an operation for recording (or storing) a voice signal. However, various operations (or functions) carried out after an echo signal is filtered out are not limited to the aforementioned example.

In various embodiments, though not illustrated in FIG. 7, while the electronic device 101 outputs an audio signal by using any one speaker among a plurality of speakers 360 and 370 included in the electronic device 101 in a state in which an external electronic device is not connected to the electronic device 101, the electronic device 101 may cancel an echo signal, based at least partly on a delay time which is set corresponding to a speaker outputting an audio signal and a parameter related with a filter which corresponds to the speaker outputting the audio signal. For example, the electronic device 101 may set differently a delay time for canceling an echo and a parameter related with a filter corresponding to a speaker outputting an audio signal, to the speaker 360 and the speaker 370. However, an embodiment is not limited to this, and the electronic device 101 may set identically the delay time for canceling the echo and the parameter related with the filter, to the speaker 360 and the speaker 370 as well.

In various embodiments, though not illustrated in FIG. 7, the delay time for canceling the echo and the parameter related with the filter may be set differently depending on whether the second external electronic device 330 is an electronic device including a 3-pole terminal or is an electronic device including a 4-pole terminal including the M terminal 404. However, an embodiment is not limited to this, and the delay time for canceling the echo and the parameter related with the filter may be set identically to the electronic device including the 3-pole terminal and the electronic device including the 4-pole terminal as well.

Figure 10:
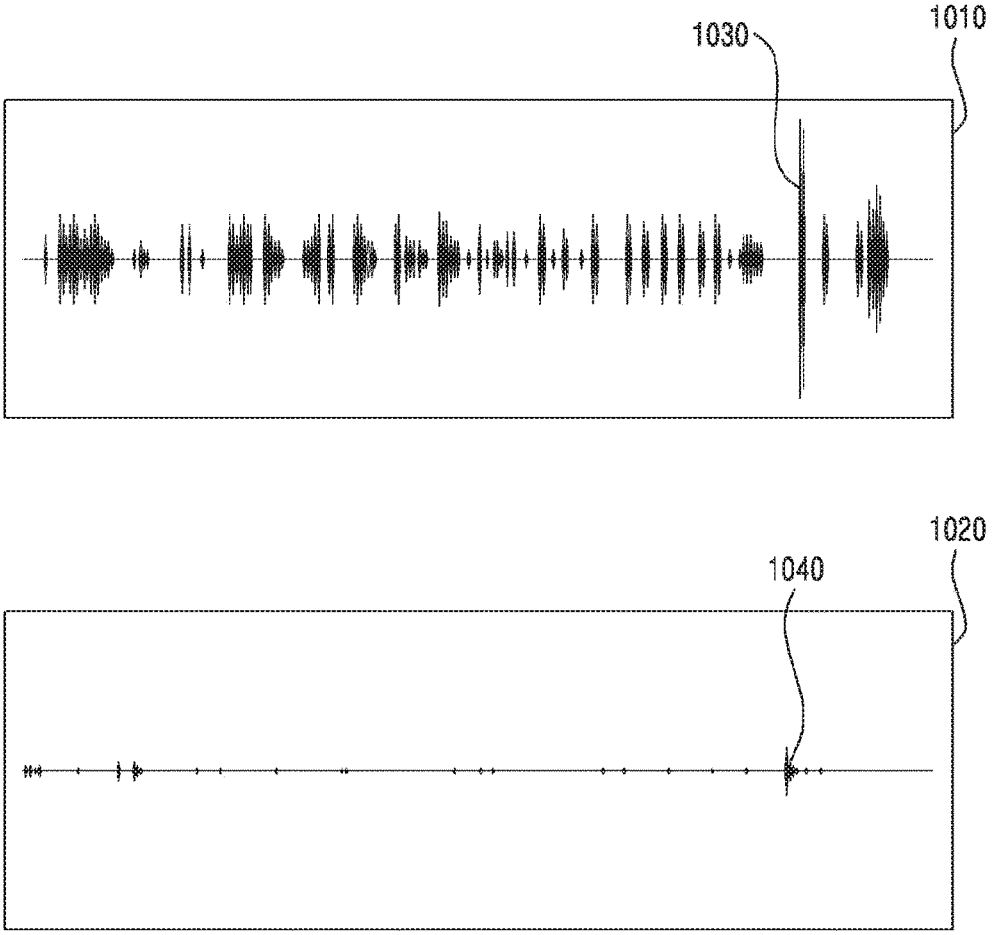
FIG. 10 is a diagram illustrating graphs showing voice signals measured before and after applying of an audio processing method according to an embodiment of the disclosure.

FIG. 10 is a diagram illustrating graphs showing voice signals which are measured before and after applying of an audio processing method according to an embodiment of the disclosure.

Referring to FIG. 10, in an embodiment a graph 1010 may be a graph showing a signal 1030 which is outputted after an echo signal outputted from the first external electronic device 320 is non-linear filtered by using a delay time being set corresponding to the second electronic device 101 and a parameter related with the non-linear filter 540, in response to the external cable 310 being connected to the electronic device 101.

As illustrated in graph 1010, it may be seen in graph 1010 that the signal 1030 includes more non-linear components.

In an embodiment, graph 1020 may be a graph showing a signal 1040 which is outputted after an echo signal outputted from the first external electronic device 320 is non-linear filtered by using a delay time being set corresponding to the external cable 310 and a parameter related with the non-linear filter 540 corresponding to the external cable 310, in response to the external cable 310 being connected to the electronic device 101.

As illustrated in graph 1020, it may be seen in graph 1020 that the signal 1040 includes a very small non-linear component compared to the signal 1030 (or does not substantially include the non-linear component).

A method for processing an audio signal and an electronic device for supporting the same according to various embodiments of the disclosure may improve echo cancellation performance, by applying a delay time related with an echo signal and a parameter of a filter which are set differently according to an external electronic device connected to the electronic device.

A method for processing an audio signal according to various embodiments of the disclosure may include identifying whether an external cable including a resistor having a resistance value of a designated magnitude or more and connecting with a first external electronic device is connected to a connector, and in response to identifying that the external cable is connected to the connector, transmitting a first audio signal to the first external electronic device through the external cable, and receiving a second audio signal including an echo signal which is outputted from the first external electronic device and corresponds to the first audio signal, and a voice signal which is inputted by a user, through at least one microphone, and canceling the echo signal corresponding to the first audio signal, based at least partly on a delay time corresponding to the external cable and a parameter related with a filter corresponding to the external cable, among a plurality of delay time related with an echo signal and a plurality of parameters related with a filter, which are set to correspond to each of a second external electronic device being connectable to the connector and including a resistor having a resistance value less than the designated magnitude, and the external cable.

In various embodiments, identifying whether the external cable is connected to the connector may include identifying that an external device is connected to the connector, and in response to identifying that the external device is connected to the connector, identifying whether the external device is the external cable or is the second external electronic device.

In various embodiments, the second external electronic device may include an external electronic device including a 3-pole terminal or an external electronic device including a 4-pole terminal, and identifying whether the external electronic device is the external cable or is the second external electronic device may include, in response to identifying that the external electronic device is connected to the connector, identifying whether the external electronic device is the external cable, or is the external electronic device including the 3-pole terminal, or is the external electronic device including the 4-pole terminal.

In various embodiments, the method may further include, in response to identifying that the external device is not connected to the connector, while outputting an audio signal through one speaker among a plurality of speakers, receiving, through the at least one microphone, an echo signal outputted form the one speaker and a voice signal inputted to a user, and canceling an echo signal outputted from the one speaker, based at least partly on a delay time corresponding to the one speaker and a parameter related with a filter corresponding to the one speaker, among a plurality of delay time related with an echo signal and a plurality of parameters related with the filter, which are set to correspond to the plurality of speakers respectively.

In various embodiments, the filter may include a linear filter and a non-linear filter, and canceling the echo signal corresponding to the audio signal may include canceling the echo signal corresponding to the first audio signal, based at least partly on a delay time and a parameter related with at least one of the linear filter or the non-linear filter, which correspond to the external cable.

In various embodiments, the method may further include setting long the delay time corresponding to the external cable, compared to the delay time corresponding to the second external electronic device.

In various embodiments, the method may further include setting the parameter related with the non-linear filter corresponding to the external cable to apply a greater echo signal cancellation level to the echo signal, compared to a parameter related with a non-linear filter corresponding to the second external electronic device.

In various embodiments, in response to the non-linear filter including a plurality of non-linear parameters, canceling the echo signal corresponding to the audio signal may include canceling a non-linear echo component of the echo signal by using more non-linear parameters among the plurality of non-linear parameters, in response to the external cable being connected to the connector, compared to the second external electronic device being connected to the connector.

For instance, the above embodiments have been described for echo signal cancellation, but the canceled signal is not limited to the echo signal, and even reverberation signal cancellation may be included in an embodiment of the disclosure.

In various embodiments, the external cable includes an auxiliary cable.

In various embodiments, transmitting the audio signal to the first external electronic device through the external cable may include transmitting the first audio signal to the first external electronic device through the external cable during the execution of a call application, a voice recognition application, an audio reproduction application or an application for providing a voice message.

Also, a data structure used in the aforementioned embodiment of the disclosure may be recorded in a computer-readable recording medium through various means. The computer-readable recording medium includes a storage medium such as a magnetic storage medium (for example, a read only memory (ROM), a floppy disc, a hard disc, etc.) and/or an optical reading medium (for example, a CD-ROM, a digital versatile disc (DVD), etc.).

In an embodiment, a computer-readable recording medium may record a program for identifying in an electronic device whether an external cable including a resistor having a resistance value of a designated magnitude or more and connecting with a first external electronic device is connected to a connector, and in response to identifying that the external cable is connected to the connector, transmitting a first audio signal to the first external electronic device through the external cable, and receiving a second audio signal including an echo signal which is outputted from the first external electronic device and corresponds to the first audio signal, and a voice signal which is inputted by a user, through at least one microphone, and canceling the echo signal corresponding to the first audio signal, based at least partly on a delay time corresponding to the external cable and a parameter related with a filter corresponding to the external cable, among a plurality of delay time related with an echo signal and a plurality of parameters related with a filter, which are set to correspond to each of a second external electronic device being connectable to the connector and including a resistor having a resistance value less than the designated magnitude, and the external cable.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An electronic device comprising:

a communication circuit;

at least one microphone;

a connector configured to connect with an external cable or an external electronic device; and a processor configured to:

identify whether the external cable, which is connected with a first external electronic device and comprises a resistor having a resistance value equal to or greater than a designated resistance value, is connected to the connector, in response to identifying that the external cable is connected to the connector, control the communication circuit to transmit a first audio signal to the first external electronic device through the external cable, receive a second audio signal comprising an echo signal and a voice signal, the echo signal being output from the first external electronic device and corresponding to the first audio signal, the voice signal being input by a user through the at least one microphone, and cancel the echo signal corresponding to the first audio signal, based at least partly on a delay time corresponding to the external cable and a parameter related with a filter corresponding to the external cable, among a plurality of delay times related with the echo signal and a plurality of parameters related with the filter, which are set to respectively correspond to one of a second external electronic device or the external cable being connected to the connector, the second external electronic device being connectable to the connector with a second cable comprising a resistor having a resistance value less than the designated resistance value.

2. The electronic device of claim 1, wherein the processor is further configured to:

identify that the external electronic device is connected to the connector; and in response to identifying that the external electronic device is connected to the connector, identify whether the external electronic device comprises the external cable or the second external electronic device.

3. The electronic device of claim 2, wherein the second external electronic device comprises a 3-pole terminal or a 4-pole terminal, and wherein the processor is further configured to, in response to identifying that the external electronic device is connected to the connector, identify whether the external electronic device comprises the external cable, or whether the external electronic device comprises the second external electronic device comprising the 3-pole terminal or the 4-pole terminal.

4. The electronic device of claim 2, further comprising:

a plurality of speakers, wherein the processor is further configured to:

in response to identifying that the external electronic device is not connected to the connector, while outputting an audio signal through one speaker among the plurality of speakers, receive, through the at least one microphone, the echo signal output from the one speaker and the voice signal input by the user; and cancel the echo signal outputted from the one speaker, based at least partly on a delay time corresponding to the one speaker and a parameter related with a filter corresponding to the one speaker, among the plurality of delay times related with the echo signal and the plurality of parameters related with the respective filter, which are set to correspond to the plurality of speakers, respectively.

5. The electronic device of claim 1, wherein the filter comprises a linear filter and a non-linear filter, and wherein the processor is further configured to cancel the echo signal corresponding to the first audio signal, based at least partly on a delay time and a parameter related with at least one of the linear filter or the non-linear filter, which correspond to the external cable.

6. The electronic device of claim 5, wherein the delay time corresponding to the external cable is set at a longer time than the delay time corresponding to the second external electronic device.

7. The electronic device of claim 5, wherein the parameter related with the non-linear filter corresponding to the external cable is set to apply a greater echo signal cancellation level to the echo signal, compared to a parameter related with a non-linear filter corresponding to the second external electronic device.

8. The electronic device of claim 5, wherein, in response to the non-linear filter comprising a plurality of non-linear parameters, the processor is further configured to cancel a non-linear echo component of the echo signal by using more non-linear parameters among the plurality of non-linear parameters when the external cable is connected to the connector.

9. The electronic device of claim 1, wherein the external cable comprises an auxiliary cable.

10. The electronic device of claim 1, wherein the processor is further configured to control the communication circuit to transmit the first audio signal to the first external electronic device through the external cable during an execution of at least one of a call application, a voice recognition application, an audio reproduction application, or an application for providing a voice message.

11. A method for processing an audio signal, the method comprising:

identifying whether an external cable, which is connected with a first external electronic device and comprises a resistor having a resistance value equal to or greater than a designated resistance, is connected to a connector;

in response to identifying that the external cable is connected to the connector, transmitting a first audio signal to the first external electronic device through the external cable;

receiving a second audio signal comprising an echo signal and a voice signal, the echo signal being output from the first external electronic device and corresponding to the first audio signal, the voice signal being input by a user through at least one microphone; and cancelling the echo signal corresponding to the first audio signal, based at least partly on a delay time corresponding to the external cable and a parameter related with a filter corresponding to the external cable, among a plurality of delay times related with the echo signal and a plurality of parameters related with the filter, which are set to respectively correspond to one of a second external electronic device or the external cable being connected to the connector, the second external electronic device being connectable to the connector with a second cable comprising a resistor having a resistance value less than the designated resistance value.

12. The method of claim 11, wherein the identifying of whether the external cable is connected to the connector comprises:

identifying that an external electronic device is connected to the connector; and in response to identifying that the external electronic device is connected to the connector, identifying whether the external electronic device comprises the external cable or the second external electronic device.

13. The method of claim 12, wherein the second external electronic device comprises a 3-pole terminal or a 4-pole terminal, and wherein the identifying of whether the external electronic device comprises the external cable or the second external electronic device comprises, in response to identifying that the external electronic device is connected to the connector, identifying whether the external electronic device comprises the external cable, or whether the external electronic device comprises the second external electronic device comprising the 3-pole terminal or the 4-pole terminal.

14. The method of claim 12, further comprising:

in response to identifying that the external electronic device is not connected to the connector, while outputting an audio signal through one speaker among a plurality of speakers, receiving, through the at least one microphone, the echo signal output from the one speaker and the voice signal input by the user; and cancelling the echo signal output from the one speaker, based at least partly on a delay time corresponding to the one speaker and a parameter related with a filter corresponding to the one speaker, among the plurality of delay times related with the echo signal and the plurality of parameters related with the filter, which are set to correspond to the plurality of speakers, respectively.

15. The method of claim 11, wherein the filter comprises a linear filter and a non-linear filter, and wherein the cancelling of the echo signal corresponding to the first audio signal comprises cancelling the echo signal corresponding to the first audio signal, based at least partly on a delay time and a parameter related with at least one of the linear filter or the non-linear filter, which correspond to the external cable.

16. The method of claim 15, further comprising setting the delay time corresponding to the external cable at a longer time than the delay time corresponding to the second external electronic device.

17. The method of claim 15, further comprising setting the parameter related with the non-linear filter corresponding to the external cable to apply a greater echo signal cancellation level to the echo signal, compared to a parameter related with a non-linear filter corresponding to the second external electronic device.

18. The method of claim 15, wherein, in response to the non-linear filter comprising a plurality of non-linear parameters, the cancelling of the echo signal corresponding to the first audio signal comprises cancelling a non-linear echo component of the echo signal by using more non-linear parameters among the plurality of non-linear parameters, when the external cable is connected to the connector.

19. The method of claim 11, wherein the external cable comprises an auxiliary cable.

20. The method of claim 11, wherein the transmitting of the first audio signal to the first external electronic device through the external cable comprises transmitting the first audio signal to the first external electronic device through the external cable during an execution of at least one of a call application, a voice recognition application, an audio reproduction application, or an application for providing a voice message.

* * * * *